US006161692A

United States Patent [19]

Lizarraga

[11] Patent Number: 6,161,692

[45] Date of Patent: Dec. 19, 2000

[54] MULTI-PURPOSE GOLF BAG

[76] Inventor: Hector Lizarraga, 12125 Kear Pl., Suite C., Poway, Calif. 92064

[21] Appl. No.: 09/225,662

[22] Filed: Jan. 5, 1999

[51] Int. Cl.[7] ..... A63B 55/00; A63B 55/08

[52] U.S. Cl. ..... 206/315.3; 206/315.4; 206/315.5; 150/159; 280/DIG. 6

[58] Field of Search ..... 280/DIG. 6; 150/159; 206/315.2–315.6

[56] References Cited

U.S. PATENT DOCUMENTS

| | | | |
|---|---|---|---|
| 1,176,031 | 3/1916 | Cady | 206/315.7 X |
| 1,325,692 | 12/1919 | Cross | 206/315.4 |
| 1,899,825 | 2/1933 | Reach | 206/315.4 |
| 2,509,195 | 5/1950 | Barron | 206/315.4 |
| 2,732,871 | 1/1956 | Drown | 206/315.6 X |
| 3,559,709 | 2/1971 | Seibold | 206/315.8 |
| 3,941,398 | 3/1976 | Nelson | 206/315.6 X |
| 3,953,045 | 4/1976 | Feret, Jr. | 206/315.6 X |
| 4,142,563 | 3/1979 | Ackerfeldt et al. | 206/315.6 X |
| 4,143,694 | 3/1979 | Gregory | 206/315.2 X |
| 4,200,131 | 4/1980 | Chitwood et al. | 150/1.5 R |
| 4,334,612 | 6/1982 | Beato | 190/18 A X |
| 4,383,563 | 5/1983 | Kirchhoff, Jr. | 206/315.2 |
| 4,522,299 | 6/1985 | Clark et al. | 206/315.3 |
| 4,643,302 | 2/1987 | Baumgardner | 206/315.3 X |
| 4,767,001 | 8/1988 | Kim | 206/315.3 |
| 4,796,789 | 1/1989 | Willcocks | 224/202 |
| 4,905,827 | 3/1990 | Kim | 206/315.5 X |
| 4,961,497 | 10/1990 | Sherer et al. | 206/315.4 |
| 5,002,185 | 3/1991 | Schurman | 206/315.4 |
| 5,096,059 | 3/1992 | Henderson | 206/315.3 X |
| 5,102,529 | 4/1992 | Hickin | 206/315.6 X |
| 5,159,999 | 11/1992 | Voigt | 190/111 |
| 5,474,175 | 12/1995 | Gattis | 206/315.3 |
| 5,515,897 | 5/1996 | Fehan | 206/315.4 X |
| 5,632,496 | 5/1997 | Nelson | 206/315.4 X |
| 5,662,220 | 9/1997 | Schurman | 206/349 |
| 5,687,843 | 11/1997 | Yuill | 206/315.3 |
| 5,699,906 | 12/1997 | Lombardo et al. | 206/315.3 |
| 5,730,285 | 3/1998 | Sheehan | 206/315.3 |
| 5,860,519 | 1/1999 | Meyer et al. | 206/315.3 |

*Primary Examiner*—Sue A. Weaver
*Attorney, Agent, or Firm*—Gary L. Eastman

[57] ABSTRACT

A Multi-Purpose Golf Bag includes a rigid storage tube for protecting golf clubs, and includes a number of smaller tubes sized to receive the golf club shafts. Each individual tube holds one golf club and keeps that club from banging and rattling against the other clubs. The Multi-Purpose Golf Bag also includes a rigid lid which may be securely fastened to the rigid storage body. The Multi-Purpose Golf Bag may also be equipped with a carrying strap and handles for carrying the Multi-Purpose Golf Bag. The Multi-Purpose Golf Bag may also include a removable wheel assembly and a removable storage bag which may be strapped to the Multi-Purpose Golf Bag during use, yet removed when traveling on an airplane.

19 Claims, 8 Drawing Sheets

MULTI-PURPOSE GOLF BAG

FIELD OF THE INVENTION

The present invention relates generally to devices used to protect golf clubs. More specifically, the present invention pertains to devices used to protect golf clubs during transport. The present invention is particularly, though not exclusively, useful as a rugged golf bag with which a user may safely ship golf clubs while traveling and may also be used to carry the clubs during a game of golf.

BACKGROUND OF THE INVENTION

Over the past century, the sport of golf has become one of the most popular activities around the world. As a result of this popularity, golf club manufacturers have designed and marketed clubs for golfers having virtually every skill level. In fact, these golfers often own expensive clubs which may be custom designed to fit their individual needs. Due to golf's increasing popularity, numerous golf courses and resorts are being built around the world every year to meet the public demand for course time. Thus, it has become a common practice for people who golf to bring their golf clubs when vacationing or traveling for business. Ordinarily, golf clubs are kept in a golf bag when not in use. These golf bags are typically made of a soft material, such as leather or nylon. Unfortunately, transporting golf clubs in a typical soft bag can result in damage to the clubs. For example, if a golfer is traveling via airplane and is checking his or her clubs at the baggage counter, these clubs could be damaged by the baggage handlers or luggage may shift in flight thereby crushing the clubs.

In an effort to minimize the damage to golf clubs during travel, the rigid golf bag was invented. Such a device, as disclosed in U.S. Pat. No. 4,383,563, which issued to Kirchhoff for an invention entitled "Golf Bag" (the "'563 patent"), consists of a rigid body, a separate interior tube for the shaft of each club, and a rigid lid. The device of the '563 patent includes a compartment for any golf accessory imaginable and as such, is quite useful. However, this bag is quite heavy and can only be comfortably carried for short periods of time. The device of the '563 patent is cumbersome when traveling, and if used on the golf course, a golf cart or a caddy is necessary to carry it.

A second rigid golf bag, as disclosed in U.S. Pat. No. 4,796,789, which issued to Willcocks for an invention entitled "Dual-Function Golf Bag" (the "'789 patent"), is also large and bulky, and includes a rigid shell for holding the clubs and interior compartments for carrying accessories. The device of the '789 patent, however, does not include wheels for rolling the bag through an airport or on a golf course. Moreover, the device of the '789 patent does not include separate tubes for each golf club shaft to keep the club shafts from damaging each other within the rigid golf bag.

In addition to the rigid golf bag, the golf bag container was invented as a solution to the problem of safely transporting golf clubs. Such a device, as disclosed in U.S. Pat. No. 4,961,497, which issued to Sherer et al. for an invention entitled "Golf Bag Container" (the "'497 patent"), consists of a large, rigid tube in which a soft golf bag can be inserted. The device of the '497 patent, however, does not have wheels and the user must not only carry the weight of the loaded golf bag, but also the weight of the rigid case. The device of the '497 patent also has limited functionality—it is only a sleeve for a golf bag and does serve any other purpose.

Accordingly, it is an object of the present invention to provide a rigid golf bag which safely protects the golf clubs during transport. It is another object of the present invention to provide a rigid golf bag which may be used on the golf course as a traditional golf bag. It is another object of the present invention to provide a rigid golf bag which is lightweight and easy to carry. It is another object of the present invention to provide a rigid golf bag which may be easily rolled if necessary. It is another object of the present invention to provide a rigid golf bag which is sleek, stylish, easy to use, and inexpensive to manufacture.

SUMMARY OF THE INVENTION

In accordance with the present invention, a Multi-Purpose Golf Bag is provided which includes a rigid storage tube for protecting golf clubs when they are placed inside. The rigid storage tube is capped at the lower end and open at the upper end. Within the rigid storage tube are a plurality of smaller tubes, sized to receive golf club shafts. Each individual tube holds one golf club and keeps that club from banging and rattling against the other clubs.

The Multi-Purpose Golf Bag also includes a rigid lid. One end of the rigid lid is tapered so that it fits snugly within the top of the rigid storage tube. The other end of the rigid lid is capped so that nothing may penetrate the Multi-Purpose Golf Bag when the rigid lid is installed on the rigid tube. The Multi-Purpose Golf Bag may also include a means for securely fastening the rigid lid to the rigid storage tube, such as a two piece combination lock.

Attached to the side of the rigid storage tube is a strap for carrying the Multi-Purpose Golf Bag slung over one shoulder. A first handle is attached to the rigid storage tube for carrying the Multi-Purpose Golf Bag with one hand and a second handle is attached to the rigid lid to facilitate lifting and carrying the Multi-Purpose Golf Bag, or rolling the Multi-Purpose Golf Bag during transport.

When removed, the rigid lid may be hung from the rigid storage tube and used to store golf balls, shoes, or any other accessory. In this position, the rigid lid may also be used as an ice bucket to keep drinks or food cold.

The Multi-Purpose Golf Bag of the present invention may also include a variety of accessories to expand its functionality. A removable wheel assembly may be included with the Multi-Purpose Golf Bag. This removable wheel assembly may fit over the bottom end of the rigid storage tube. This would allow the Multi-Purpose Golf Bag to be rolled through an airport or across a golf course. Additionally, a removable storage bag may be included with the Multi-Purpose Golf Bag. This removable storage bag may be strapped to the Multi-Purpose Golf Bag with one or more straps wrapped around the rigid storage body. This removable storage bag may store a variety of golf accessories or it may serve as a carry-on bag when traveling on an airplane.

These accessories to the Multi-Purpose Golf Bag may be removed when the Multi-Purpose Golf Bag is being used to transport the clubs. For example, before checking the Multi-Purpose Golf Bag at a baggage counter, the user may detach the removable storage bag and the removable wheel assembly. The user may then place the removable wheel assembly inside the removable storage bag, check the Multi-Purpose Golf Bag without the accessories, and carry the removable storage bag on the plane.

The Multi-Purpose Golf Bag of the present invention overcomes many of the disadvantages of the previous rigid golf bags. For example, the present invention provides a rigid golf bag which is lightweight and compact. The multi-functionality of the present invention allows it to be used as a secure means for protecting golf clubs during transport, or it may be used as a traditional golf bag on a golf course. The removable accessories make the transition from transport case to golf bag quick and easy. Additionally, the present invention may be easily rolled or carried in an airport or on a golf course.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF A PREFERRED EMBODIMENT

Figure 1:
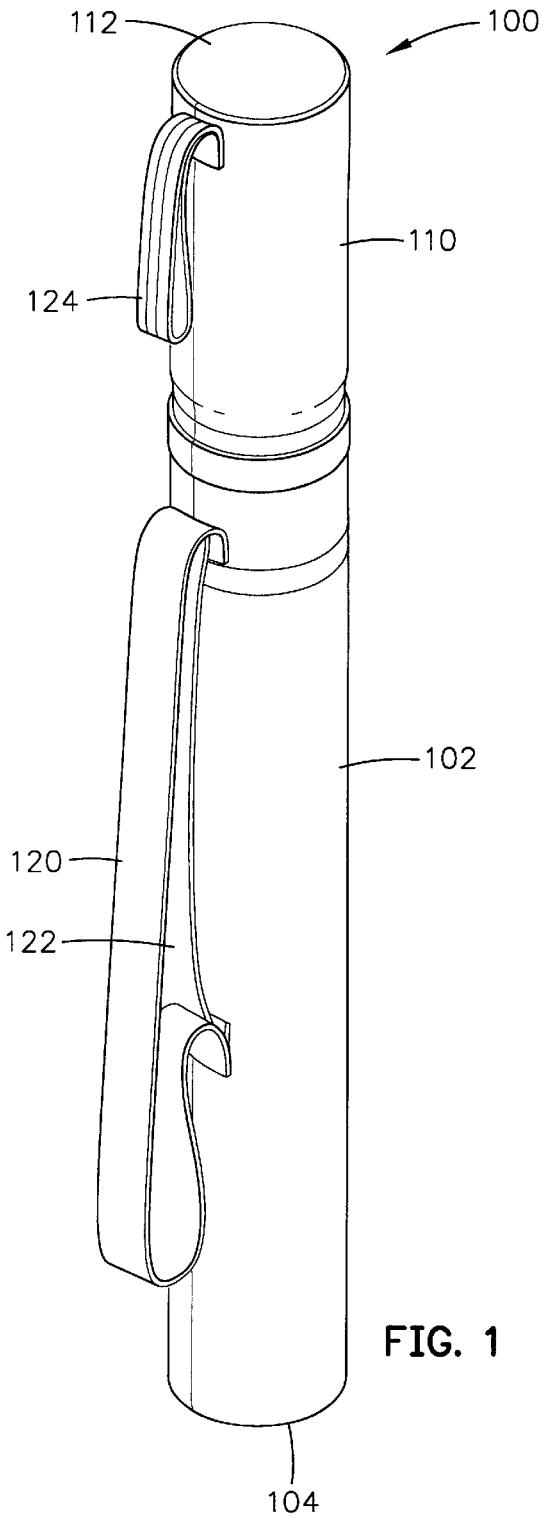
FIG. 1 is a perspective view of the Multi-Purpose Golf Bag of the present invention showing the handles and strap attached to the back of the Multi-Purpose Golf Bag.

Referring initially to FIG. 1 for an overview, a Multi-Purpose Golf Bag in accordance with the present invention is shown and generally designated 100.

Figure 2:
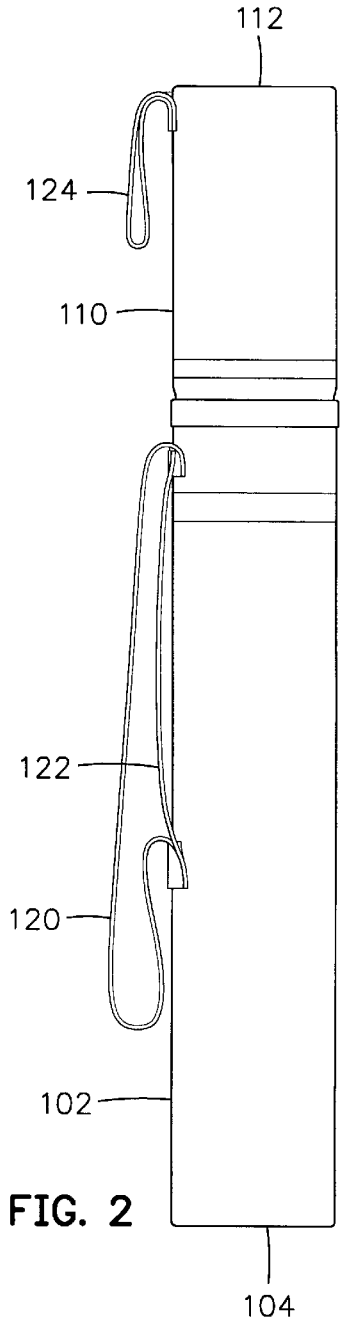
FIG. 2 is a right-side plan view of the Multi-Purpose Golf Bag of the present invention.
Figure 8:
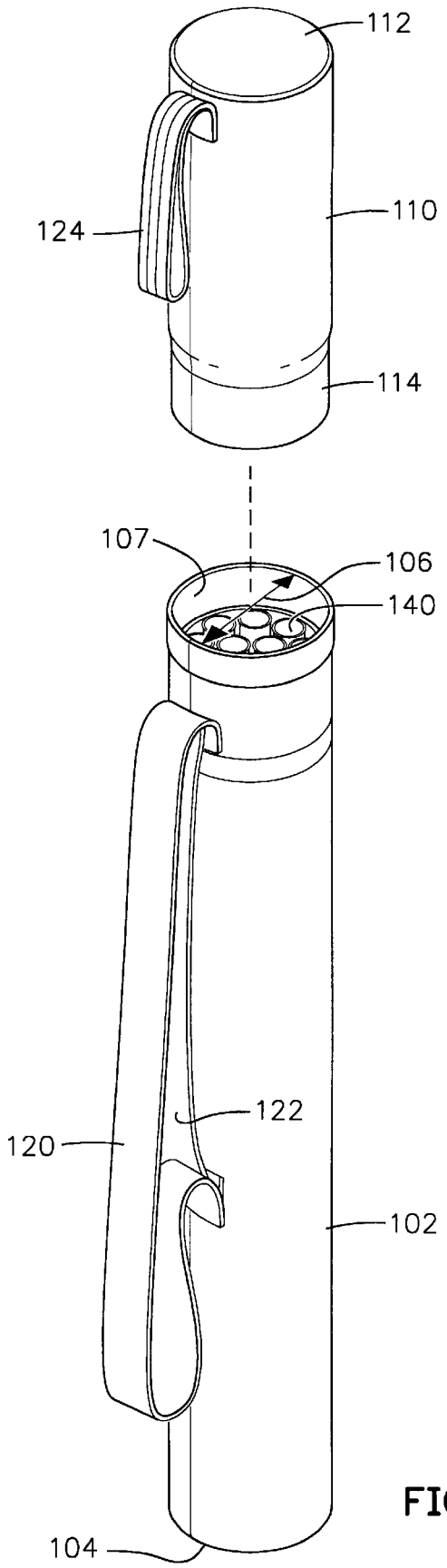
FIG. 8 is a perspective view of the Multi-Purpose Golf Bag of the present invention showing the removal of the rigid lid.
Figure 12:
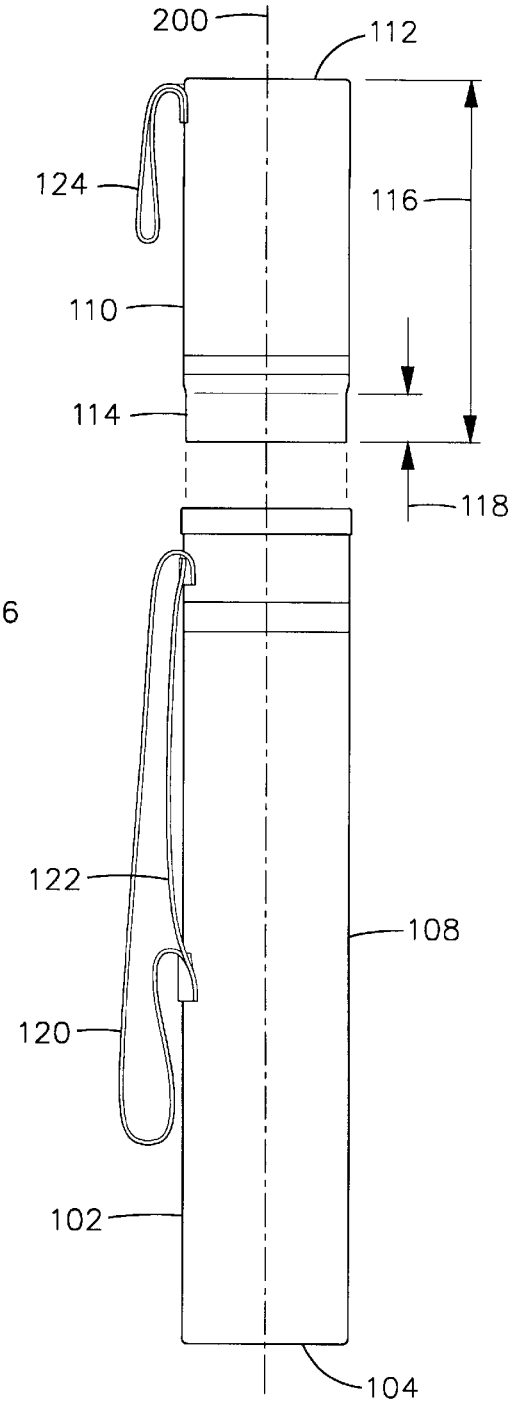
FIG. 12 is a right side plan view of the Multi-Purpose Golf Bag of the present invention showing the rigid lid removed from the rigid storage body.

FIG. 2 shows the rigid storage body 102 with the rigid lid 110 inserted into it. FIG. 12 shows the rigid lid 110 removed from the rigid storage body 102. The rigid storage body 102 has a length 108. FIG. 8 shows the rigid storage body 102 with an opening 107 having internal diameter 106. FIG. 12 also shows the rigid lid 110 having an overall length 116. The rigid lid 110 includes a tapered sleeve 114 having a length 118. The tapered sleeve 114 may have an external diameter (not shown) which is slightly smaller than the internal diameter 106 of the rigid storage body 102. The rigid lid 110 fits snugly on the rigid storage body 102 by sliding the tapered sleeve 114 into the opening 107 in the rigid storage body 102 along axis 200. In a preferred embodiment, the rigid storage body 102 and the rigid lid 110 may be constructed from 6", 8", or 10" PVC pipe and PVC fittings, but any material of with similar strength and weight characteristics well known in the art may suffice. Also, in a preferred embodiment, the exterior surfaces of the rigid storage body 102 and the rigid lid 110 may be covered with neoprene cloth, but any material of similar characteristics well known in the art may suffice.

Figure 6:
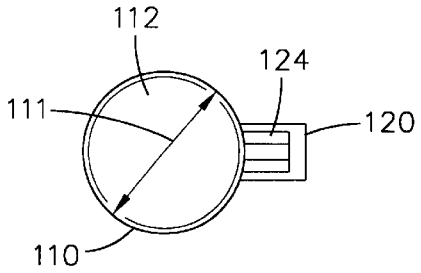
FIG. 6 is a top plan view of the Multi-Purpose Golf Bag of the present invention.
Figure 7:
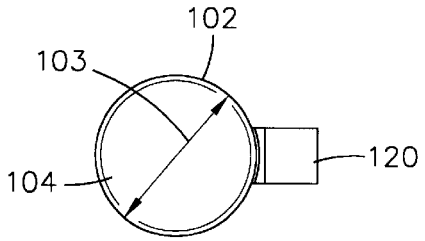
FIG. 7 is a bottom plan view of the Multi-Purpose Golf Bag of the present invention.

Referring again to FIG. 8, the rigid storage body 102 has an opening 107 at the top and a capped bottom 104. The rigid lid 110 has an opening (not shown) at the bottom and a capped top 112. When the rigid lid 110 is inserted into the rigid storage body 102 as shown by FIGS. 1,2,3,4 and 5, the Multi-Purpose Golf Bag 100 of the present invention is completely sealed. FIGS. 6 and 7 clearly show the capped top 112 of the rigid lid 110 and the capped bottom 104 of the rigid storage body 102. The external diameter 111 of the rigid lid 110 is approximately equal to the external diameter 103 of the rigid storage body 102.

Figure 9:
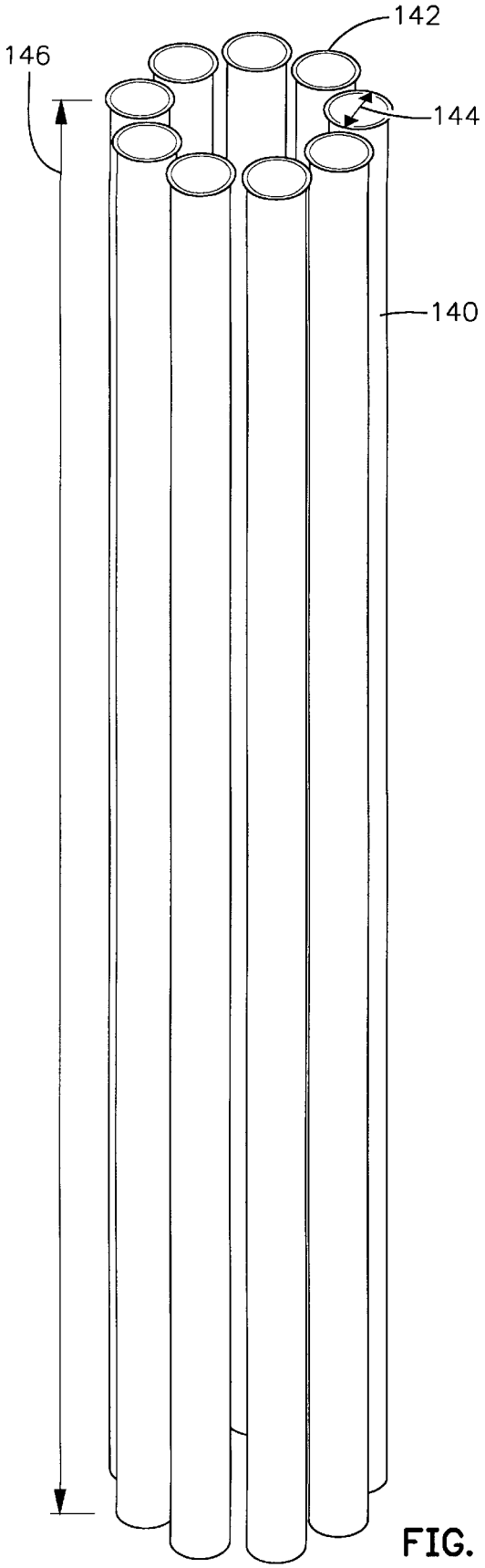
FIG. 9 is a perspective view of the internal tube cluster located within the rigid storage tube is a rear plan view of the Vest With Detachable.

FIG. 8 shows a cluster of tubes 140 inserted into the rigid storage body 102. FIG. 9 shows this cluster of tubes 140 removed from the rigid storage body 102. The cluster of tubes 140 consists of a plurality of identical tubes 142 with a diameter 144 and a length 146. Each individual tube 142 holds a single golf club (not shown) and keeps that club from banging against the other golf clubs. In a preferred embodiment, each tube 142 may be constructed of plastic, but it is to be appreciated that any material of similar characteristics well known in the art may be used.

The diameter 144 of each tube 142 is slightly larger than the diameter of a typical golf club shaft (not shown). The length 146 of each tube 142 is dependant not only on the length of the golf club shafts (not shown), but also on the length 118 of the tapered sleeve 114. The length 146 of each tube 142 is such that the difference between the length 108 of the rigid storage body 102 and the length 146 of the tube cluster 140 is greater than the length 118 of the tapered sleeve 114. This will allow the rigid lid 110 to be fully inserted into the rigid storage body 102 without coming into contact with the tube cluster 140.

Figure 3:
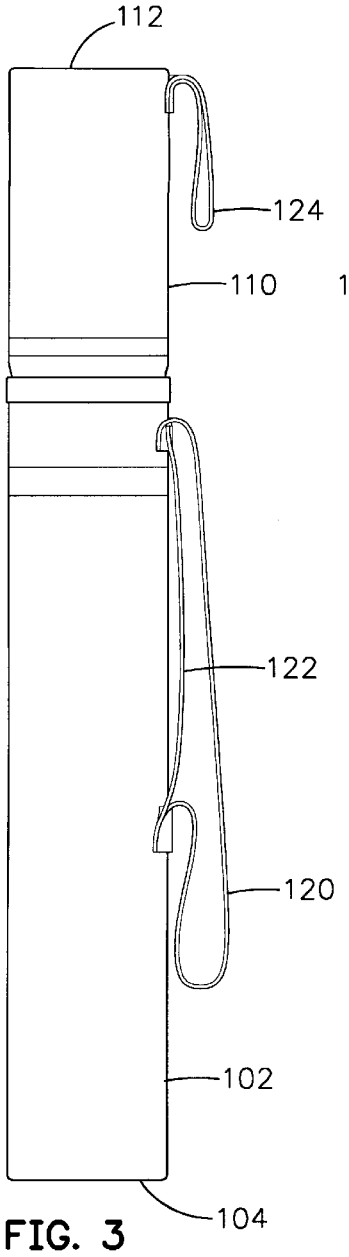
FIG. 3 is a left-side plan view of the Multi-Purpose Golf Bag of the present invention.
Figure 4:
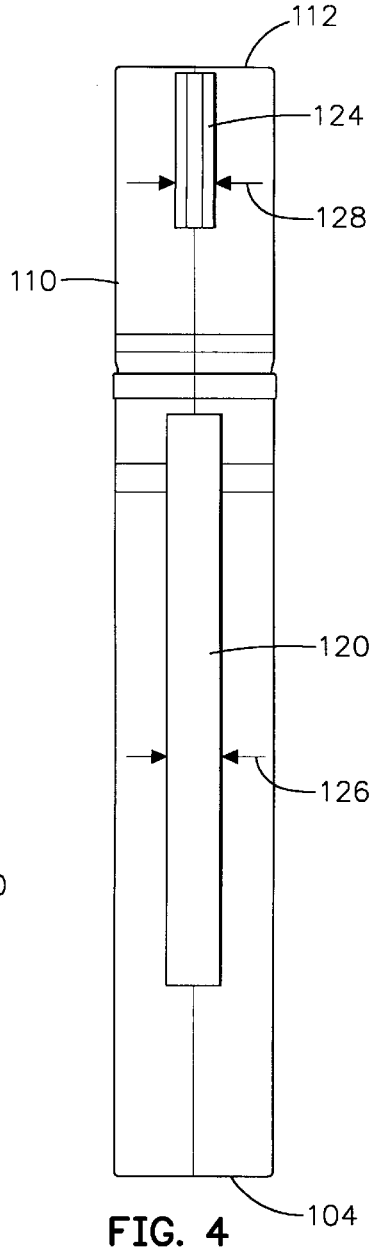
FIG. 4 is a rear plan view of the Multi-Purpose Golf Bag of the present invention.
Figure 5:
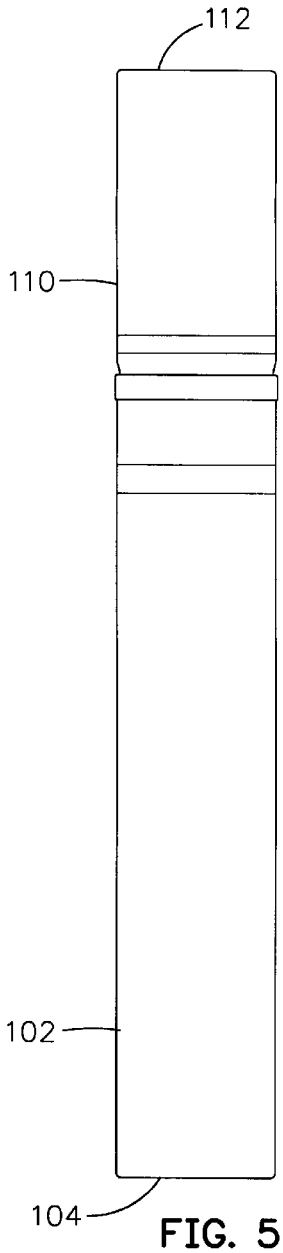
FIG. 5 is a front plan view of the Multi-Purpose Golf Bag of the present invention.

Referring now to FIGS. 2,3 and 4, it is shown that the Multi-Purpose Golf Bag 100 of the present invention includes carrying handles. Attached to the rigid storage body 102 is a strap 120 for carrying the Multi-Purpose Golf Bag 100 over one shoulder. Also attached to the rigid storage body 102 is a first handle 122 for lifting and carrying the Multi-Purpose Golf Bag 100 with one hand. A second handle 124 is attached to the rigid lid 110 to facilitate lifting and carrying the Multi-Purpose Golf Bag 100.

FIG. 4 shows the strap 120 with a width 126 and the second handle 124 with a width 128. The width of the first handle 122 is not shown. In a preferred embodiment, the strap 120, the first handle 122, and the second handle 124 are constructed from nylon, but it is to be appreciated that any material with similar properties well known in the art may be used.

Figure 10:
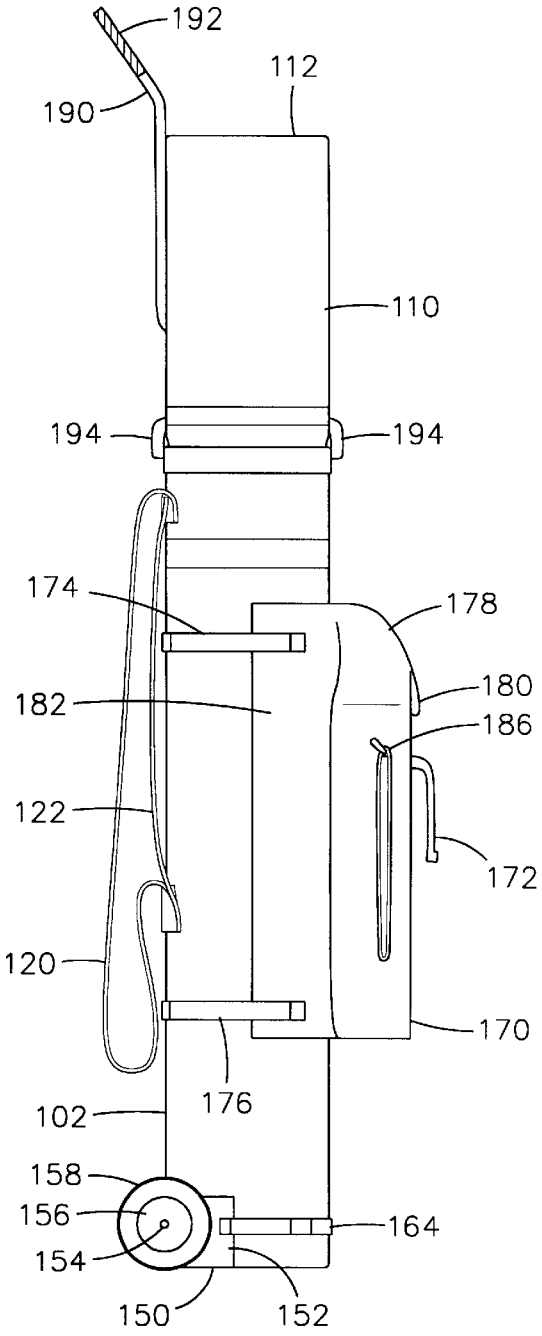
FIG. 10 is a right side plan view of the Multi-Purpose Golf Bag of the present invention as it is used in conjunction with the removable accessories.
Figure 11:
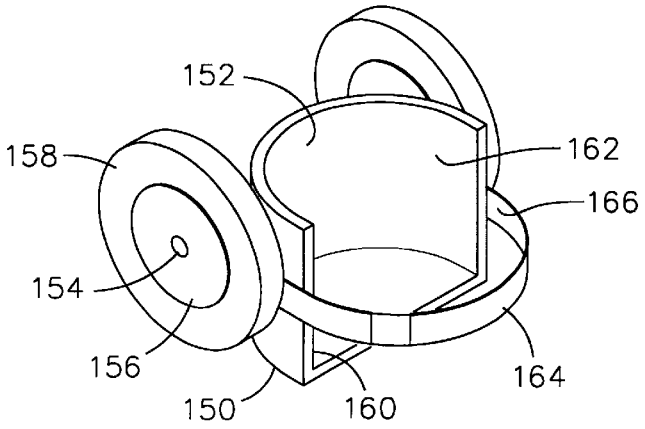
FIG. 11 is a perspective view of the removable wheel assembly.

FIG. 10 shows the Multi-Purpose Golf Bag 100 with the removable wheel assembly 150 and the removable storage bag 170 attached to it. FIG. 11 shows the removable wheel assembly 150 detached from the Multi-Purpose Golf Bag 100. The removable wheel assembly consists of a semi-circular cylindrical cup 152 which fits over the capped bottom 104 of the rigid storage body 102 and is held in place with a strap 164. The strap 164 is attached to one side of the semi-circular cylindrical cup 152 at slot 160. The free end 166 of the strap can then be inserted through slot 162 and then folded back onto itself and held in place using hook-and-loop material.

Figure 13:
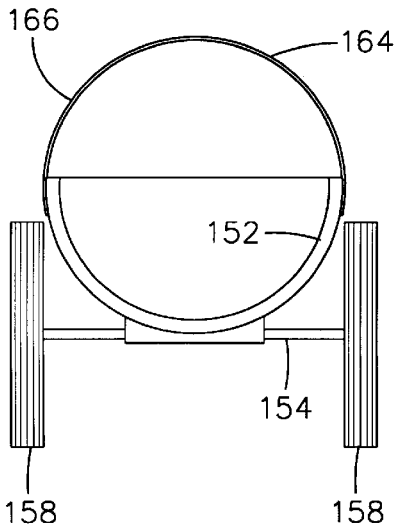
FIG. 13 is a top plan view of the removable wheel assembly.

The wheel assembly 150 includes an axle 154 with two wheels 156 and two solid tires 158. FIG. 13 shows one wheel 156 and solid tire 158 is attached to the axle 154 on each side of the semi-circular cylindrical cup 152. In a preferred embodiment, the semi-circular cylindrical cup 152 and the wheels 154 may be constructed from plastic or any similar material well known in the art. Also, in a preferred embodiment, the tires 158 may be constructed from solid rubber, but any similar material well known in the art may be sufficient.

Figure 14:
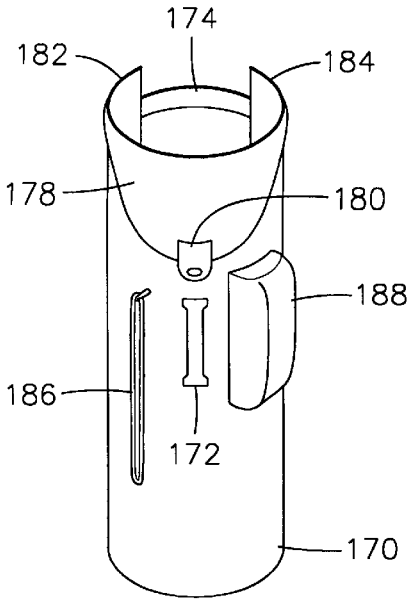
FIG. 14 is a perspective view of the removable storage pouch.
Figure 15:
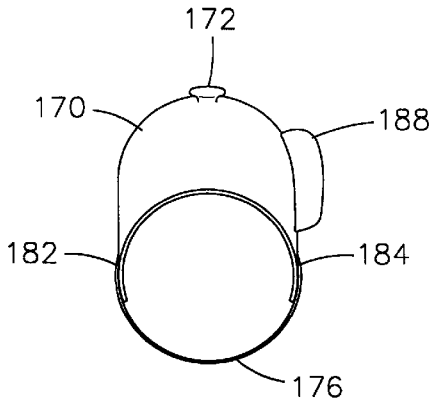
FIG. 15 is a bottom plan view of the removable storage pouch.

FIG. 10 shows the removable storage pouch 170 strapped to the rigid storage body 102 by an upper strap 174 and a lower strap 176. FIGS. 14 and 15 shows the removable storage pouch 170 detached from the Multi-Purpose Golf Bag. One end of the upper strap 174 and one end of the lower strap 176 is firmly attached to the left flap 182 of the removable storage pouch 170. The upper strap 174 and the lower strap 176 may be wrapped around the rigid storage body 102 and attached to the right flap 184 with hook-and-loop material.

The removable storage pouch 170 includes an upper flap 178 which holds stored accessories within the removable storage pouch 170. The upper flap 178 is securely closed with a clasp 180. The removable storage pouch 170 also includes a handle 172 which may be used to carry the removable storage pouch 170 when it is detached from the Multi-Purpose Golf Cart 100.

To facilitate the storage of a variety of accessories, the removable storage pouch 170 includes a zippered envelope-like pocket 186 and a side-mounted pouch 188. In a preferred embodiment, the removable storage pouch 170 may be constructed from neoprene, but it is to be appreciated that any material with similar characteristics well known in the art may be used. The removable storage pouch 170 may be configured in a variety of ways, but it is important, regardless of the configuration, that the removable storage pouch 170 include the left flap 182 and the right flap 184 and at least the upper strap 174 and the lower strap 176.

FIG. 10 shows that the second handle 124 may be replaced with a rigid handle 190 having a grip 192. This rigid handle can then be used to tow the Multi-Purpose Golf Cart 100 through an airport or on a golf course. FIG. 10 also shows that the rigid lid 110 may be securely fastened to the rigid storage body 102 with one or more locking clasps 194, such as a two piece plastic clasp with a combination lock.

Figure 16:
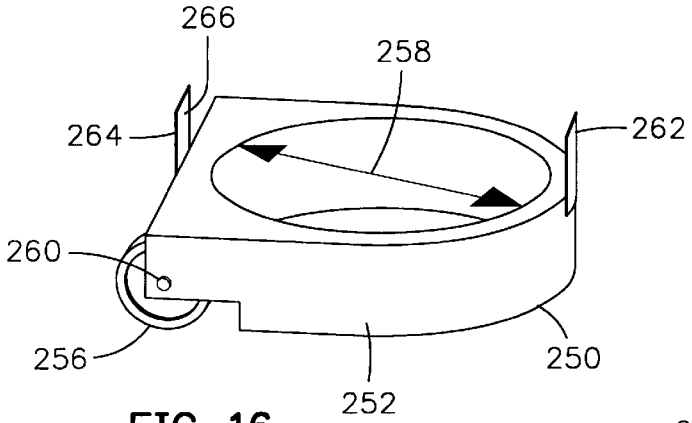
FIG. 16 is a perspective view of an alternative embodiment of the removable wheel assembly.
Figure 17:
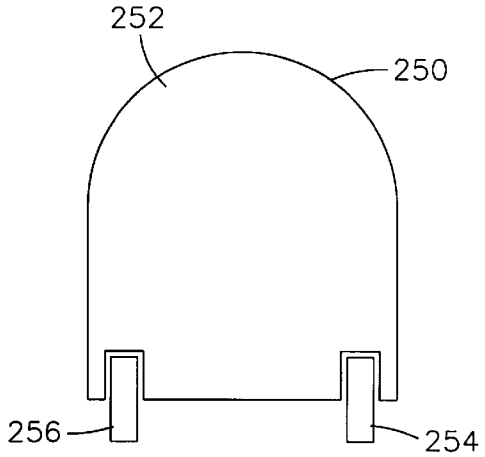
FIG. 17 is a bottom plan view of an alternative embodiment of the removable wheel assembly.

FIG. 16 and FIG. 17 show an alternative embodiment of the removable wheel assembly 250 including a boot 252, a left wheel 254 and a right wheel 256. The boot 252 has an internal diameter 258 slightly larger than the external diameter 103 of the rigid storage body. The left wheel 254 and the right wheel 256 are attached to the boot 252 by axle 260. In this embodiment, the boot 252 is constructed from plastic or a material with similar characteristics well known in the art. The left wheel 254 and the right wheel 256 are constructed from solid rubber or a material with similar characteristics well known in the art.

FIG. 16 shows a front strap 262 and a rear strap 264 attached to the boot 250. The front strap 262 and the rear strap 264 include a fastener 266 for securely fastening the boot 250 to the Multi-Purpose Golf Bag 100. In this embodiment the fastener 266 is a snap-type device, but any similar fastener well known in the art will suffice. Additionally, in this embodiment the front strap 262 and the rear strap 264 are constructed from nylon. It can be appreciated that the front strap 262 and the rear strap 264 may be constructed from any material possessing similar characteristics well known in the art.

Figure 18:
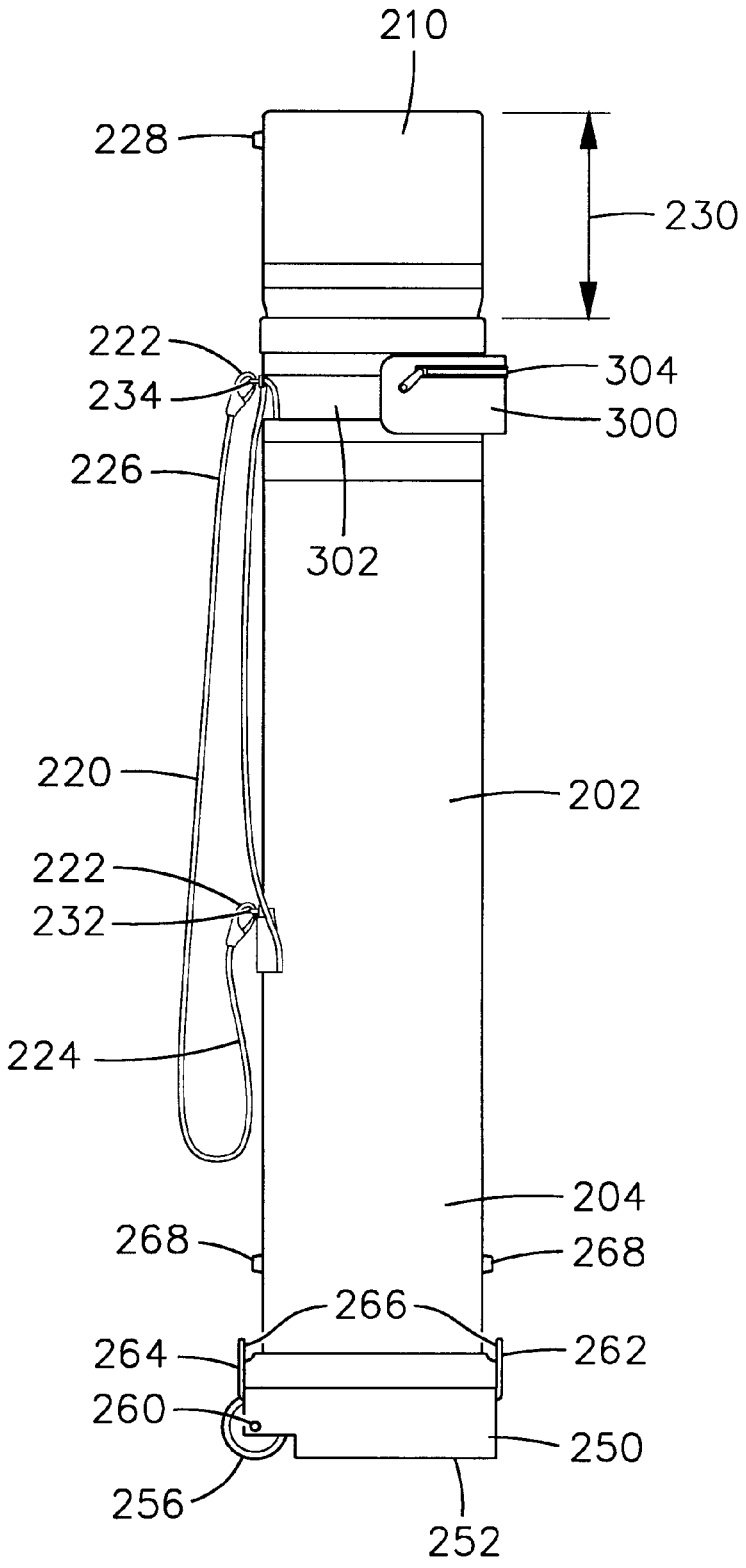
FIG. 18 is a right plan view of an alternative embodiment of the Multi-Purpose Golf Bag of the present invention showing the attachment of an alternative embodiment of the removable wheel assembly.

FIG. 18 shows an alternative embodiment of the Multi-Purpose Golf Bag generally designated 200. This alternative embodiment of the Multi-Purpose Golf Bag 200 includes a rigid storage body 202 and a rigid lid 210. The rigid lid 210 has a length 230. It can be appreciated that the Multi-Purpose Golf Bag 200 of the present invention may be used for applications other than as a golf bag. The cluster of tubes 140 may be removed from the rigid storage body 202 and other long objects may be stored and shipped within the Multi-Purpose Golf Bag 200. Such objects may include blue-prints, works of art and supplies, posters, fishing rods, rifles, or any other similarly shaped object. Depending on the application the Multi-Purpose Golf Bag 200 is used for, the length 230 of the rigid lid 210 may vary.

FIG. 18 shows a removable shoulder strap 220 attached to the rigid storage body 202. The removable shoulder strap 220 includes a proximal end 224 with a hook 222 and a distal end 226 with a hook 222. The proximal end 224 of the removable shoulder strap 220 may be attached to the rigid storage body 202 by clipping the hook 222 to the lower ring 232. The distal end 226 of the removable shoulder strap 220 may be attached to the rigid storage body 202 by clipping the hook 222 to the upper ring 234.

The rigid storage body 202 also includes two fasteners 268 which will mate with the fasteners 266 attached to the front strap 262 and the rear strap 264 of the alternative embodiment of the removable wheel assembly 250. It can be appreciated that this alternative embodiment of the removable wheel assembly 250 may be securely attached to the rigid storage body 202 by slipping the boot 252 over the base 204 of the rigid storage body 202 and snapping the front strap 262 and the rear strap 264 to the fasteners 268.

FIG. 18 shows a foot 228 attached to the rigid lid 210 on the same side as the wheels 254 & 256. The foot 228 allows this embodiment of the Multi-Purpose Golf Bag 200 to be laid horizontally on its side. When laid on its side, this alternative embodiment of the Multi-Purpose Golf Bag 200 will rest on the left wheel 254, the right wheel 256 and the foot 228. FIG. 18 also shows a small removable pouch 300 with a left strap 302, a right strap (not shown), and a zippered storage compartment 304. The left strap 302 and the right strap (not shown) each includes an eyelet (not shown) sized to fit over the upper ring 234. Each eyelet (not shown) is placed over the upper ring 234 and held in place by attaching the hook 222 on the distal end 226 of the shoulder strap 220 to the upper ring 234.

Figure 19:
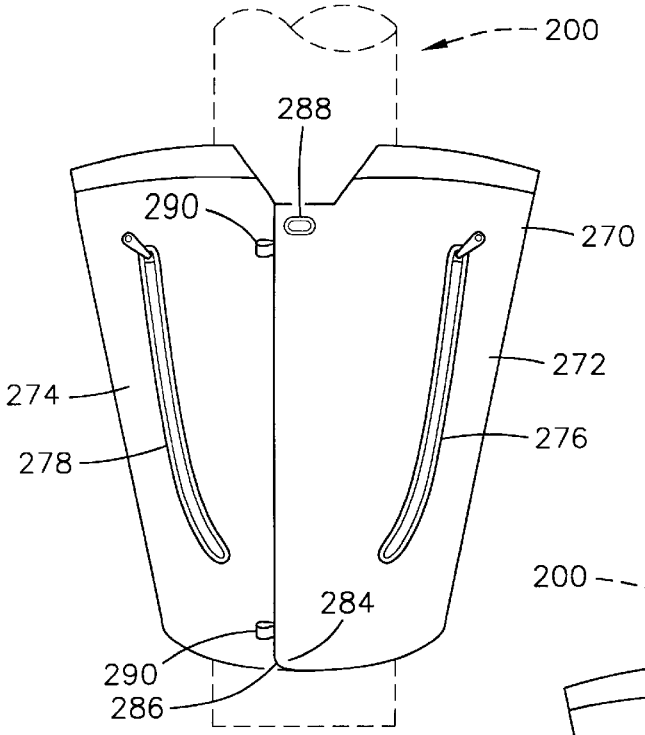
FIG. 19 is a front plan view of an alternative embodiment of the removable storage pouch attached to the Multi-Purpose Golf Bag which is shown in phantom.
Figure 20:
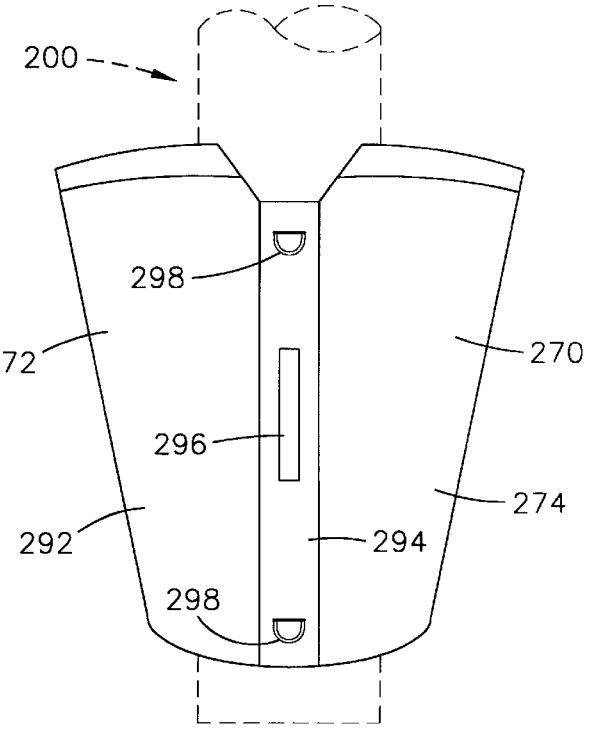
FIG. 20 is a rear plan view of an alternative embodiment of the removable storage pouch attached to the Multi-Purpose Golf Bag which is shown in phantom.
Figure 21:
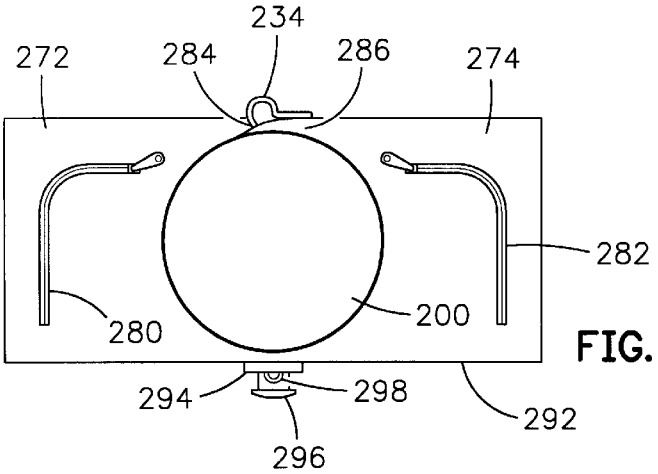
FIG. 21 is a top plan view of an alternative embodiment of the removable storage pouch.

FIGS. 19, 20, and 21 show an alternative embodiment of the removable storage pouch 270 attached to an alternative embodiment of the Multi-Purpose Golf Bag 200. This alternative embodiment of the removable storage pouch 270 includes a left side 272 and a right side 274. The left side 272 includes the lower left storage compartment 276, the upper left storage compartment 280, and the left flap 284. The right side 274 includes the lower right storage compartment 278, the upper right storage compartment 282, and the right flap 286. It can be appreciated that this alternative embodiment of the removable storage pouch 270 may be manufactured from nylon or any material with similar characteristics well known in the art.

The left flap 284 and the right flap 286 each includes an eyelet 288 which is sized to fit over the lower ring 232 on the rigid storage body 202. The right side 274 of the removable storage pouch 270 wraps around the rigid storage body and the eyelet (not shown) in the right flap 286 fits over the lower ring 232. The left side 272 of the removable storage pouch 270 also wraps around the rigid storage body 202 and the eyelet 288 in the left flap 284 fits over the lower ring 232 on top of the eyelet (not shown) in the right flap 286. The eyelets 288 are then held in place by attaching the hook 222 on the proximal end 224 of the removable shoulder strap 220 to the lower ring 232.

The left flap 284 overlaps the right flap 286 and is held securely in place by opposing strips of hook-and-loop material installed on the exterior surface (not shown) of the right flap 286 and the interior surface (not shown) of the left flap 284. The right flap 286 also includes one or more tags 290. These tags 290 provide handles that the user may grip when cinching the left flap 284 tightly over the right flap 286.

The back 292 of the removable storage pouch 270 includes a spine 294. This spine 294 provides structural stiffness for the removable storage pouch 270 and includes a handle 296 which may be used to carry the removable storage pouch 270 when it is detached from the rigid storage body 202. The spine 294 also includes two rings 298 which serve as attachment points for the removable shoulder strap 220.

It can be appreciated that this alternative embodiment of the removable storage pouch 270 hangs on the sides of the rigid storage body 202 and does not significantly add to the front to rear depth of the rigid storage body 202. It can also be appreciated that this alternative embodiment of the removable storage pouch hangs very low on the rigid storage body 202. This will result in a low center of gravity so that the Multi-Purpose Golf Bag 200 is less likely to tip over when standing.

While the particular Multi-Purpose Golf Bag as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A golf bag comprising:

a rigid cylindrical hollow storage body having a capped bottom and an open top;

a rigid cylindrical hollow lid having a capped top and an open bottom, said open bottom of said rigid lid sized to be slidably insertable into said open top of said storage body; and a covering, said covering constructed of neoprene cloth and covering the exterior surface of said storage body and said lid.

2. The golf bag in claim 1, further comprising:

a removable wheel assembly attached to said capped bottom of said storage body.

3. The golf bag in claim 2, wherein said removable wheel assembly further comprises:

a boot, said boot defining an opening, said opening sized to receive said capped bottom of said storage body;

a left wheel and a right wheel, said left wheel attached to a left side of an axle, said right wheel attached to a right side of said axle, wherein said axle is attached to said boot;

a front strap and a rear strap, said front strap attached to a front side of said boot, and said rear strap attached to a rear side of said boot; and wherein said front and said rear straps retain said removable wheel assembly on said golf bag.

4. The golf bag in claim 3, further comprising a removable storage pouch, said pouch attachable to said storage body.

5. The golf bag in claim 4, further comprising a removable shoulder strap, said removable shoulder strap comprising a proximal end and a distal end, said proximal end attachable to a lower ring of said storage body, said distal end attachable to an upper ring of said rigid storage body.

6. The golf bag in claim 2, wherein said removable wheel assembly further comprises a semi-circular cup defining an opening, said opening sized to receive a portion of said capped bottom of said storage body, said cup further comprising:

a left attachment member and a right attachment member, said left attachment member is located on the left side of said semi-circular cup and formed to create a slot, said right attachment member is located on the right side of said semi-circular cup and formed to create a slot;

a strap having a free end and an attached end, said attached end secured to said left attachment member, said free end insertable through said right attachment member;

a left wheel and a right wheel, said left wheel attached to a left side of an axle, said right wheel attached to a right side of said axle, wherein said axle is attached to said cup;

a left tire and a right tire, said left tire attached to said left wheel and said right tire attached to said right tire; and wherein said strap retains said removable wheel assembly on said golf bag.

7. The golf bag in claim 6, further comprising a removable storage pouch, said pouch further comprising;

a left flap and a right flap, said left flap attached to a left side of said pouch and said right flap attached to a right side of said pouch;

an upper strap and a lower strap, said upper strap attached to said left flap and said right flap, said lower strap attached to said left flap and said right flap; and wherein said upper strap and said lower strap retains said pouch on said golf bag.

8. The golf bag in claim 7, further comprising a removable shoulder strap, said removable shoulder strap comprising a proximal end and a distal end, said proximal end attachable to a lower ring of said storage body, said distal end attachable to an upper ring of said storage body.

9. A golf bag comprising:

a rigid cylindrical hollow storage body having a capped bottom and an open top, said storage body formed by PVC pipe;

a rigid cylindrical hollow lid having a capped top and an open bottom, said open bottom of said lid sized to be slidably insertable into said open top of said storage body;

a removable wheel assembly attached to said capped bottom of said storage body;

a means for securely attaching said lid to said storage body so that said lid may be locked to said storage body to prevent theft of any articles stored within said golf bag; and a covering, said covering constructed of neoprene cloth and covering the exterior surface of said storage body and said lid.

10. The golf bag in claim 9, further comprising:

a cluster of tubes longitudinally positioned within said storage body, said cluster of tubes comprising a plurality of individual tubes, each said individual tube sized to receive a golf club shaft.

11. The golf bag in claim 10, wherein said removable wheel assembly further comprises:

a boot, said boot defining an opening, said opening sized to receive said capped bottom of said storage body;

a left wheel and a right wheel, said left wheel attached to a left side of an axle, said right wheel attached to a right side of said axle, wherein said axle is attatched to said boot;

a front strap and a rear strap, said front strap attached to a front side of said boot, and said rear strap attached to a rear side of said boot; and wherein said front and said rear straps retain said removable wheel assembly on said golf bag.

12. The golf bag in claim 11, further comprising a removable storage pouch, said pouch further comprising:

a left flap and a right flap, said left flap attached to a left side of said pouch and said right flap attached to a right side of said pouch;

an upper strap and a lower strap, said upper strap attached to said left flap and said right flap, said lower strap attached to said left flap and said right flap; and wherein said upper strap and said lower strap retains said pouch on said golf bag.

13. The golf bag in claim 12, further comprising a removable shoulder strap, said removable shoulder strap comprising a proximal end and a distal end, said proximal end attachable to a lower ring of said storage body, said distal end attachable to an upper ring of said storage body.

14. The golf bag in claim 12, wherein said removable wheel assembly further comprises a semi-circular cup, said cup defining an opening, said opening sized to accept said capped bottom of said storage body, said cup further comprising:

a left slot and a right slot;

a strap having a free end and an attached end, said attached end secured to said left slot, said free end insertable through said right slot;

a left wheel and a right wheel, said left wheel attached to a left side of an axle, said right wheel attached to a right side of said axle, wherein said axle is attached to said cup; and a left tire and a right tire, said left tire attached to said left wheel and said right tire attached to said right tire.

15. The golf bag in claim 14, further comprising a removable storage pouch, said pouch further comprising:

a left flap and a right flap, said left flap attached to a left side of said pouch and said right flap attached to a right side of said pouch;

an upper strap and a lower strap, said upper strap attached to said left flap and said right flap, said lower strap attached to said left flap and said right flap; and wherein said upper strap and said lower strap retains said pouch on said golf bag.

16. The golf bag in claim 15, further comprising a removable shoulder strap, said removable shoulder strap comprising a proximal end and a distal end, said proximal end attachable to a lower ring of said storage body, said distal end attachable to an upper ring of said storage body.

17. A golf bag comprising:

a storage body having a capped bottom and open top, said storage body formed by PVC pipe;

a lid having a capped top and an open bottom, said lid sized to be slidably insertable into said open top of said storage body;

a removable wheel assembly attached to said capped bottom of said storage body;

a cluster of tubes longitudinally positioned within said storage body, said cluster of tubes comprising a plurality of individual tubes, each said individual tube sized to receive a golf club shaft; and a covering, said covering constructed of neoprene cloth and covering the exterior surface of said storage body and said lid.

18. The golf bag in claim 17, further comprising a shoulder strap, said shoulder strap comprising a proximal end and a distal end, said proximal end attached to a lower ring of said storage body, said distal end attachable to an upper ring of said storage body.

19. The golf bag in claim 17, further comprising a first handle attached to said storage body and a second handle attached to said lid.

* * * * *